United States Patent [19]

Kandel

[11] 4,294,050

[45] Oct. 13, 1981

[54] TRUSS-FRAMED BUILDING STRUCTURES

[76] Inventor: Arnold Kandel, P.O. Box 416, Fairfax, Va. 22030

[21] Appl. No.: 114,747

[22] Filed: Jan. 24, 1980

[51] Int. Cl.[3] ..... E04B 7/02

[52] U.S. Cl. ..... 52/93; 52/289

[58] Field of Search ..... 52/90, 92, 93, 633, 52/639, 641, 643, 645, 289

[56] References Cited

U.S. PATENT DOCUMENTS

| | | | |
|---|---|---|---|
| 1,421,299 | 6/1922 | Palen | 52/93 |
| 3,156,018 | 11/1964 | Slayter | 52/643 X |
| 3,662,502 | 5/1972 | Wright | 52/93 |
| 3,845,592 | 11/1974 | Patena | 52/93 |
| 4,005,556 | 2/1977 | Tuomi | 52/93 |
| 4,096,670 | 6/1978 | Fuller | 52/90 |

*Primary Examiner*—J. Karl Bell

*Attorney, Agent, or Firm*—Dressler, Goldsmith, Shore, Sutker & Milnamow, Ltd.

[57] ABSTRACT

A roof truss is made of unitized wooden frame elements comprising a pair of centrally interconnected upper chords which are joined near their outer ends by a horizontal lower chord which is discontinuous near each end thereof. Vertical risers interconnect the lower chord on both sides of each discontinuity with the upper chord to form post-receiving pockets near each end of the lower chord. These pockets are preferably backed up by a prenailed gusset on one side of the truss. This roof truss is combined at the building site with a lower section comprising a floor truss having a vertical wall-forming stud at each end thereof to provide a unitized truss frame.

4 Claims, 3 Drawing Figures

Fig. 1
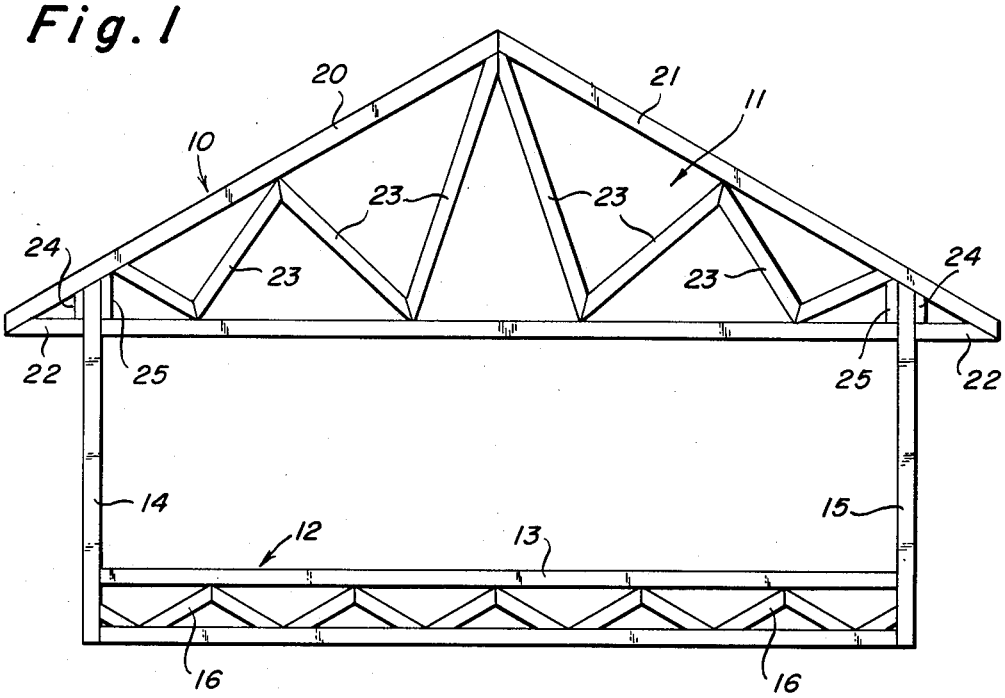
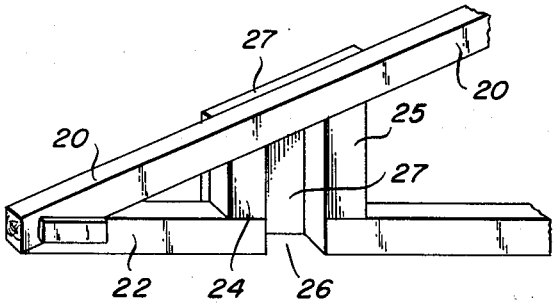
Fig. 2
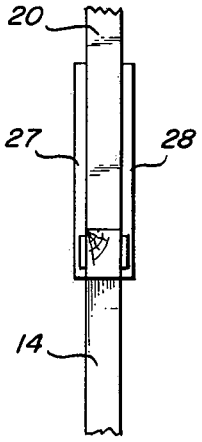
Fig. 3

TRUSS-FRAMED BUILDING STRUCTURES

DESCRIPTION

1. Technical Field

This invention relates to truss-framed building structures in which the truss frame is formed in two sections to facilitate shipment.

2. Background Art

Lightweight truss-framed buildings have been developed by the Forest Products Laboratory, Forest Service, U.S. Department of Agriculture, in which the framing system incorporates a trussed floor, trussed roof rafters and wall studs into unitized frames. These components are joined together into a unitized framework by conventional truss plates, plywood gusset plates, or other fasteners capable of transmitting moment, shear and axial forces between the components. These frames can be tilted into place, one after the other, and this enables the floor, walls and roof framing to go up as a unit, and the house or other building can then be quickly enclosed in conventional manner.

The unitized frames are assembled in plants under controlled conditions and must be shipped to the building side by truck. This severely limits the height of the frame which can be shipped, so only shallow-sloped roof designs can be handled, especially as the distance between the wall studs is increased, as is desirable. The distance between the walls is important because a feature of this construction is that intermediate supports, columns, beams and bearing partitions are not needed. This simplifies construction and provides open space between the opposed walls which allows great flexibility for interior planning in the house proper. It also simplifies the construction of and provides more open space in any basement which may be present.

Unfortunately, a shallow-sloped roof is poorly adapted to support snow loads, it is not attractive and limits design variation, and it makes it difficult to use the space in the attic because of the lack of headroom.

DISCLOSURE OF INVENTION

In accordance with this invention, a truss-framed building structure is made of unitized wooden frame elements which are formed in two separate sections. The first or upper section is a roof truss, and the second or lower section comprises a floor truss having a vertical wall-forming stud or post at each end thereof. In the roof truss, a pair of centrally interconnected upper chords which provide the upper sloped surfaces of the roof, are joined near their outer ends by a horzontal lower chord which is discontinuous near each end thereof, and vertical risers interconnect the lower chord on both sides of each discontinuity with the upper chord to form post-receiving pockets near each end of the lower chord to receive the upper ends of the wall-forming studs carried by the second or lower section.

The two sections can be as long or longer than heretofore, but shipment is greatly facilitated because the height is reduced because the roof truss is separate from the lower section. As a result, the roof truss can now have a greater slope because, without the lower section to add height to the composite, there is plenty of room to accomodate the height of the roof.

In practice, the two sections are shipped on the same truck, half of the sections carried being roof trusses, and the other half being lower sections. At the side, the two interfitting sections are load flat on the ground or on a work platform, the post or stud ends in the lower section are fitted into the post-receiving pockets in the roof truss, and a gusset is laid over the risers, post ends and adjacent portions of the upper and lower chords, and nailed or otherwise secured in place. Gang nailing is particularly convenient, but this is itself well known and forms no part of this invention. Plywood gussets can be used, and the joint is desirably secured on both sides.

In preferred practice, the post-receiving pockets in the roof truss are backed up by a prenailed gusset on one side, so only the gusset on the other side need be supplied and nailed in place when the two sections are assembled on the site.

BRIEF DESCRIPTION OF DRAWINGS

The invention is illustrated in the accompanying drawings in which:

FIG. 1 shows the overall construction of a unitized frame constructed in accordance with the invention after the two sections thereof have been assembled;

FIG. 2 is a fragmentary view, in perspective, showing one end of the roof truss section prior to insertion of the upper end of one of the wall-forming studs of the lower section; and FIG. 3 is a fragmentary end view of one end of the roof truss with the studs inserted and secured therein.

BRIEF DESCRIPTION OF DRAWINGS

Referring more particularly to the drawings, the completed unitized frame is shown in FIG. 1 is identified by numeral 10 and is constituted by two sections which are secured together, there being a roof truss 11 and a lower section 12. The lower section 12 includes a floor truss 13 which terminates in upstanding studs 14 and 15. The floor truss is itself conventional, there being upper and lower horizontal members connected together by bracing 16.

The roof truss 11 comprises a pair of centrally interconnected upper chords 20 and 21 which provide the upper sloped surfaces of the roof. These are joined near their outer ends by a horizontal lower chord 22 which is discontinuous. There are two discontinuities, one near each end of chord 22. Bracing 23 also is present to interconnect the upper chords 20 and 21 with the lower chord 22 in order to strengthen the roof truss as is conventional.

The discontinuous nature of chord 22 is more fully shown in FIG. 2 where one end of the roof truss can be seen prior to assembly with the lower section 12. It will be seen that risers 24 and 25 interconnect the lower chord 22 on both sides of the discontinuity therein with the upper chord 20 to form a post-receiving pocket 26. This pocket is shown backed with a gusset 27 which is secured to the upper chord 20, the risers 24 and 25 and the chord 22 on both sides of the discontinuity. This gusset 27 is made of plywood, and all the chords and the bracing are conveniently made of wood, 2 inches by 4 inches in size. The securement is not shown, but conventional gangnails, as illustrated at the juncture of chords 20 and 22 in FIG. 2 are particularly convenient.

The upper end of stud 14 is inserted into pocket 26 and a second gusset 28 is applied and nailed into place. The result is shown in FIG. 3. This simple insertion and nailing operation is easily carried out in the field and it produces a unitary product which is fully as strong as a unitized frame made in a single section. Of course, the single section is very difficult to ship, especially since the slope of the roof is such that the height of the single section is too great for ordinary truck shipment. The result is a simple and effective solution to what has been a perplexing and unsolved problem.

I claim:

1. A roof truss made of unitized wooden frame elements comprising a pair of centrally interconnected upper chords which provide the upper sloped surfaces of a roof, said upper chords being joined near their outer ends by a horizontal lower chord which is discontinuous near each end thereof, and vertical risers interconnecting said lower chord on both sides of each discontinuity with said upper chord to form post-receiving pockets near each end of said lower chord, said post-receiving pockets being backed up by a prenailed gusset on one side of said truss.

2. A unitized wooden frame structure comprising two secured together sections including a lower section comprising a floor truss having a vertical wall-forming stud at each end thereof, and a roof truss as recited in claim 1, the upper ends of said studs being inserted within and secured within the post-receiving pockets of said roof truss.

3. A frame structure as recited in claim 2 in which said studs are secured within said post-receiving pockets by a second gusset nailed on the other side of said frame.

4. A frame structure as recited in claim 3 in which said gussets are nailed to said upper and lower chords, said risers and said studs.

* * * * *